United States Patent [19]

Rottmayr

[11] 4,348,858

[45] Sep. 14, 1982

[54] METHOD OF AND APPARATUS FOR MAKING A DOUBLED YARN

[75] Inventor: Johann Rottmayr, Reutlingen, Fed. Rep. of Germany

[73] Assignee: Zinser Textilmaschinen GmbH, Ebersbach, Fed. Rep. of Germany

[21] Appl. No.: 262,930

[22] Filed: May 12, 1981

[30] Foreign Application Priority Data

May 14, 1980 [DE] Fed. Rep. of Germany ..... 3018551

[51] Int. Cl.[3] ..... D02G 3/36; D02G 3/38; D01H 11/00

[52] U.S. Cl. ..... 57/18; 57/304

[58] Field of Search ..... 57/3, 12, 6, 16–18, 57/304, 305

[56] References Cited

U.S. PATENT DOCUMENTS 4,170,101 10/1979 Bock ..... 57/18 X 4,226,077 10/1980 Hilbert ..... 57/18

*Primary Examiner*—John Petrakes

*Attorney, Agent, or Firm*—Karl F. Ross

[57] ABSTRACT

An apparatus for making a doubled yarn draws a core yarn off a core-yarn supply, pulls the core yarn longitudinally in a travel direction along a yarn path, and drafts the core yarn longitudinally along this path. A tube through which the yarn passes longitudinally extends along the path downstream of the drafting station has relative to the yarn-travel direction an upstream portion and a downstream portion. A current of air is passed longitudinally in the travel direction through the upstream tube portion and another current is passed longitudinally opposite the travel direction through the downstream portion. Thus upstanding fibers are first laid against the core yarn to be integrated into it as same twists in the upstream tube portion and any remaining fibers are laid back against it so that a winder yarn can be wound around the core yarn immediately downstream of the tube to bind in these fibers too.

18 Claims, 7 Drawing Figures

FIG.1
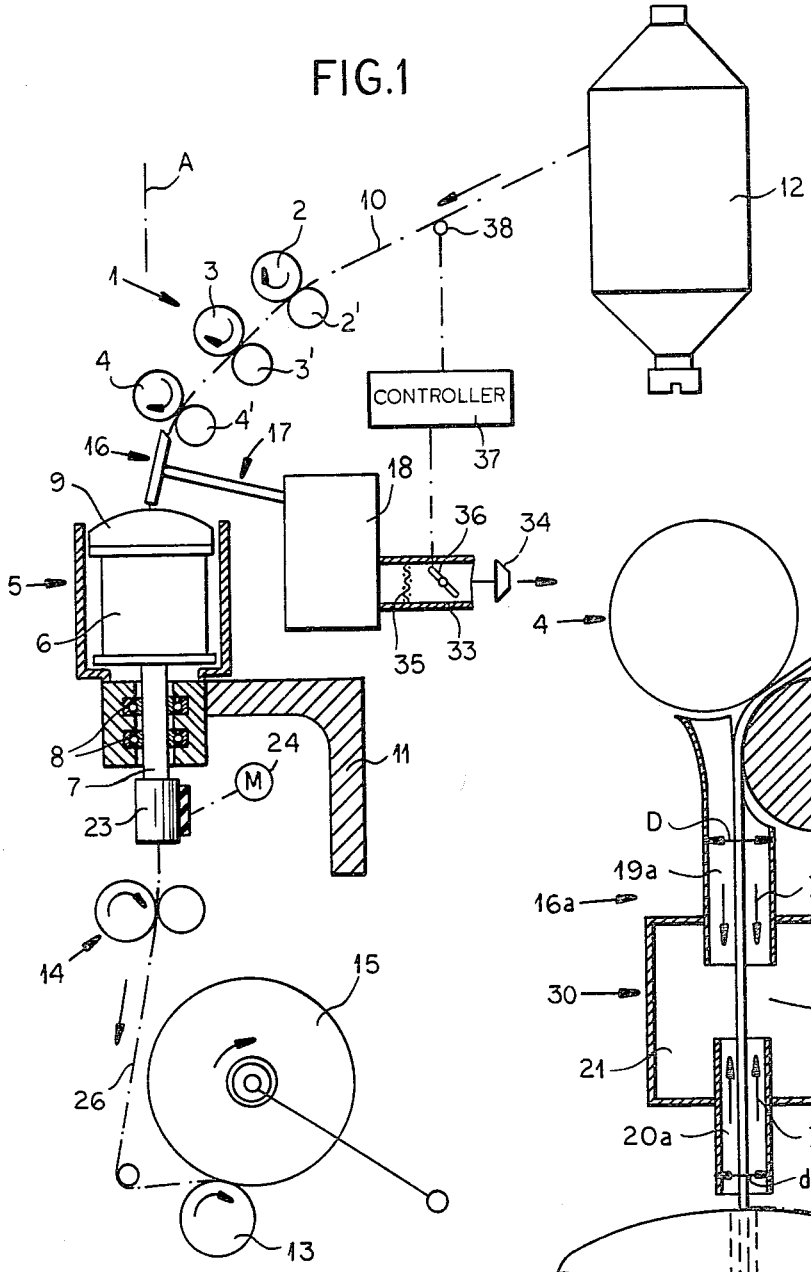
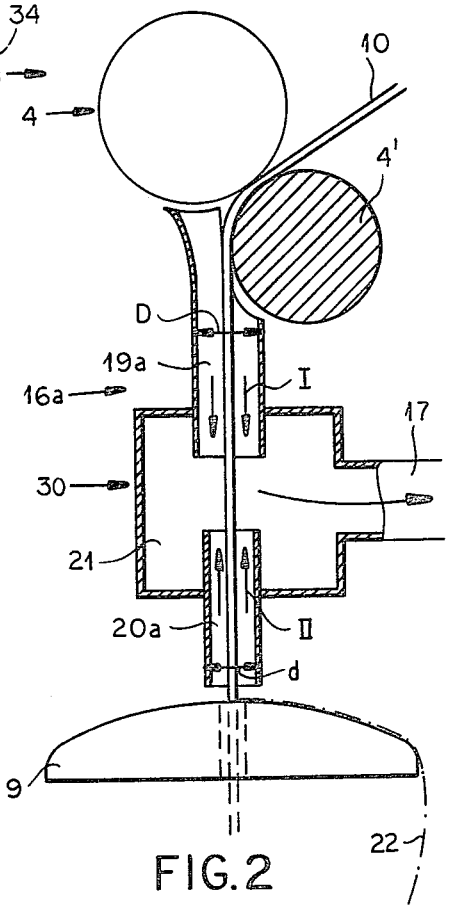
FIG.2

METHOD OF AND APPARATUS FOR MAKING A DOUBLED YARN

FIELD OF THE INVENTION

The present invention relates to a method of and an apparatus for making a doubled yarn, that is a novelty yarn having a substantially untwisted and thick core yarn and a relatively tightly twisted and thin winder yarn wrapped helically around the core yarn.

BACKGROUND OF THE INVENTION

In order to make a doubled yarn of the above-described general type it is standard practice to feed the core yarn axially through the hollow spindle of a spinning device carrying the winder yarn, so that the winder yarn is wound around the core yarn. Normally the core yarn is drafted immediately upstream of the winding location by passing it through sets of rollers rotating at peripheral speeds increasing in the travel direction.

In order to prevent loosened fibers from escaping into the air where they can foul equipment and present a health hazard for workers, it is known to create an axial air current through the spindle. Thus the loosened fibers can be sucked up and carried away. This procedure is also employed to lay loose fibers parallel to the core yarn so that they can be caught under the winder yarn. To this end the spacing between the nip of the last pair of drafting rollers engaging the core yarn and the intake end of the hollow spindle must be smaller than the average fiber length of the core yarn.

The main problem with this type of system is that it is difficult to combine it with an automatic yarn-breakage detector and yarn-trapping device. The small distance between the furthest downstream pair of drafting rollers and the winding location makes it impossible to mount the yarn-trapper in this region. The lint- or fiber-catching air stream cannot itself be employed to aspirate the broken yarn, since the winder-yarn package must be lifted off to rethread the machine.

It is also known to provide on a spinning machine a suction cap which is supported by means of fork-shaped projections on the upper roller of the output rollers. A suction tube is connected to this cap to aspirate loose fibers. Such an arrangement is not usable on the above-described type of drafting/doubling apparatus because too many fibers can work loose between the cap and the winding location.

OBJECTS OF THE INVENTION

It is therefore an object of the present invention to provide an improved method of and apparatus for making a doubled novelty yarn.

Another object is the provision of such a method and apparatus which will simultaneously insure that the maximum amount of loose fibers are bound onto the core yarn by the winder yarn and the other stray fibers are aspirated so they do not get loose to the surrounding area.

A further object is to provide such a method and apparatus which can readily be combined with a yarn-breakage detector and with a broken-yarn catching arrangement.

SUMMARY OF THE INVENTION

These objects are attained according to the instant invention in an apparatus wherein a tube is provided along the core-yarn path immediately upstream of the winding location and having an upstream portion through which a current of air is passed longitudinally in the yarn-travel direction along an upstream section of the path and a downstream portion through which a current of air is passed opposite to the yarn-travel direction. Thus the core yarn is drawn off its supply and pulled longitudinally along the yarn path, where it is drafted at a drafting station, to the tube. In the tube it is subjected first to a concurrent flow of air and then to a counter-current flow of air, so that at first any stray sticking-out fibers are laid by the concurrent stream against the core yarn where they are trapped by the false-twisting occuring immediately downstream of the last pair of drafting rollers, and then any remaining fibers are either laid back on the core yarn in the opposite direction where they can be trapped under the winder yarn or are aspirated off the core yarn altogether. The winder yarn is wound around the core yarn immediately as it exits from the tube. If the yarn breaks it will be sucked in upstream of the winding location.

According to another feature of this invention the means for passing the current of air includes an aspirating duct opening into the tube between the portions thereof and connected to a low-pressure source or ventilator for drawing air out of this tube in both directions. This aspirating duct can open into a central portion of enlarged cross-sectional area of the tube and can open at an acute angle into the tube. In fact the aspirating duct can be movable along the tube so that the tube portions are of unequal or adjustable length. The tube portions may be of the same or different cross-sectional area. In the latter case the downstream portion is normally of smaller area. The rim of the upper portion is shaped so that it can be closely juxtaposed with the adjacent drafting rollers, to ensure that minimal fiber is loosed to the surrounding area. In this manner the workers using the machine are protected from harm from breathing these fibers.

In accordance with another feature of this invention the binding-in of the fibers in the false-twisting region of the core yarn in the upstream tube portion can be enhanced by making the yarn section in this upstream tube portion relatively long. Alternatively the upstream tube portion can be formed with an inwardly extending projection that will smooth and flatten the yarn as it passes by. This projection can be a simple ridge or plurality of ridges, or a spiral ridge formed inside the upstream tube portion.

The aspirating duct according to the instant invention is connected to a ventilator. This duct is provided with a valve that is operated by a controller to open up fully when the controller detects core-yarn breakage. Thus the suction action will be increased and the broken yarn will be sucked in by the tube arrangement, so as not to fly loose and get tangled in adjacent equipment. In addition the aspirating duct may be provided with a fiber-trapping element such as a screen which can be monitored to ascertain how much lint and loose fibers is being generated by the system. Normally the volume of air sucked in by the aspirating duct is maintained as small as possible consonant with nominal quality of the doubled yarn produced.

DESCRIPTION OF THE DRAWING

FIG. 1 is a largely schematic and partly sectional side view of the apparatus for carrying out the method of the present invention;

FIG. 2 is a large-scale vertical section through a detail of another apparatus according to this invention;

SPECIFIC DESCRIPTION

Figure 3:
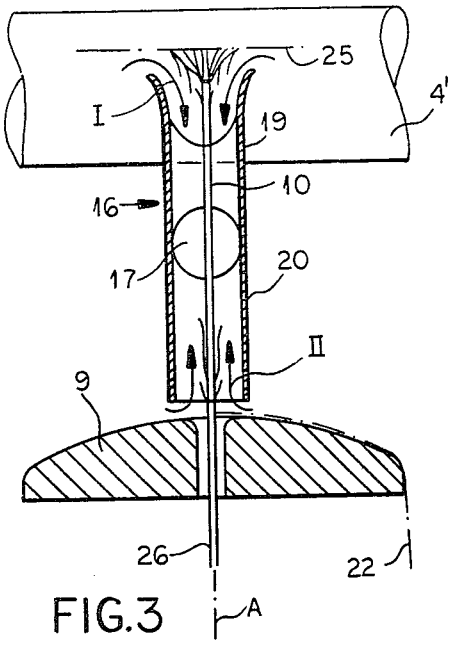
FIG. 3 is a section similar to FIG. 2 showing a detail of FIG. 1.
Figure 4:
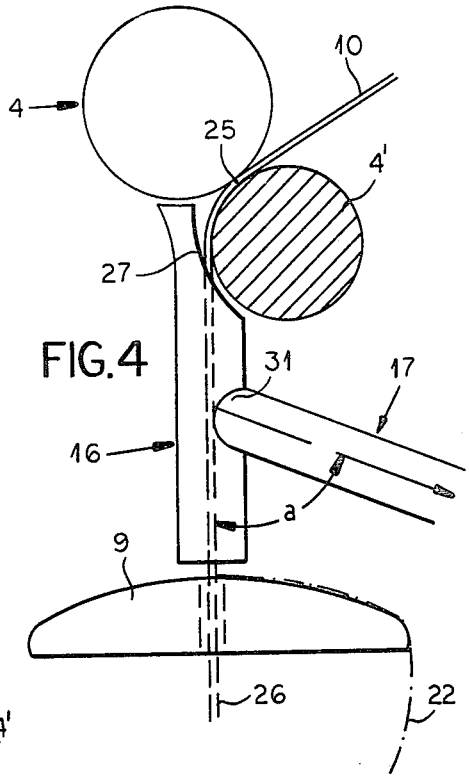
FIG. 4 is a partly sectional end view of the detail of FIG. 3.

As shown in FIG. 1 a relatively thick and loosely twisted core yarn 10 is drawn off a core-yarn supply 12 and passed through a drafting zone 1 and then through a winder 5 to a pair of output pinch rollers 14 whence it is wound up as a doubled yarn 26 onto a takeup spool 15 driven by a roller 13.

In the drafting zone 1 the core yarn 10 is drafted longitudinally. This is achieved by passing it through three pairs of driven drafting rollers 2, 2'; 3, 3'; and 4, 4'. These roller pairs pinch the yarn 10 and are driven at peripheral speeds which increase in the travel direction D.

In the winder 5 a winder-yarn supply 6 is supported on a hollow spindle 7 carried in bearings 8 in a machine frame 11 for rotation about a vertical axis A. A cap or cover 9 with a central hole at the axis A lies atop the yarn supply 6. A motor 24 is connected via a flat belt to a whorl 23 carried on the lower end of the rotatable spindle 7. The motor 24 therefore can rotate the yarn package or supply 6 at high speed to wind a winder yarn 22 (see FIG. 3) thereon about the core yarn 10.

Immediately as the core yarn 10 issues from the last two drafting rollers 4 and 4' it enters a tube 16 connected as also shown in FIGS. 2 and 3 via an aspirating duct 17 to a manifold 18 whence it is connected via another aspirating duct 33 to the intake of a fan 34. The aspirating duct 17 opens generally centrally and at an acute angle a of about 75° to the centerline of the tube 16. The tube 16 is subdivided into an upper portion 19 and a lower portion 20. The air drawn in by the ventilator 34 therefore creates in the upper portion 10 a downwardly directed current I and in the lower portion 20 an upwardly directed current II. The downwardly moving upper current I lays loose fibers against the false-twisting core yarn 10 so that they are twisted back into it, and the upwardly moving lower current II lays any remaining fibers back against the core yarn 10 so that the winder yarn 22 can flatten and bind them against the yarn 10. Any fibers that come completely loose are aspirated and trapped on a screen 35 in the duct 33 so that an operator of the machine can keep a check on how effective the device is.

The upper portion 19 has a rim 17 which is shaped so that it can lie very close to the surface of the rollers 4 and 4'. Thus the yarn 10 is exposed only over a very short distance between the line 25 where it is pinched between these rollers and the mouth of the tube 16. In this manner there is minimal opportunity for potentially hazardous fibers to be loosed into the air.

A controller 37 for the system according to the instant invention is connected to a thread-break sensor 38 and to a valve 36 in the duct 33. When the yarn 10 breaks, the controller 37 opens the valve 36 fully to ensure good aspiration of the broken yarn and any fibers generated by the breakage.

FIG. 2 shows how a tube **16*a* can be formed by an upper portion 19*a* and a lower portion 20*a* meeting in a chamber 21 formed by a box 30 of large cross-sectional area. The aspirating duct 17 opens into the box 30. In addition the upper tube portion 19*a* is of relatively large diameter D and the lower tube portion 20*a* is of relatively small diameter d so that the upper current I will be somewhat stronger than the lower current II. In addition in the event of breakage of the yarn 10, the large upper tube 19*a* can easily aspirate the core yarn 10** along with its widened frayed end and any fibers generated by such breakage.

Figure 5:
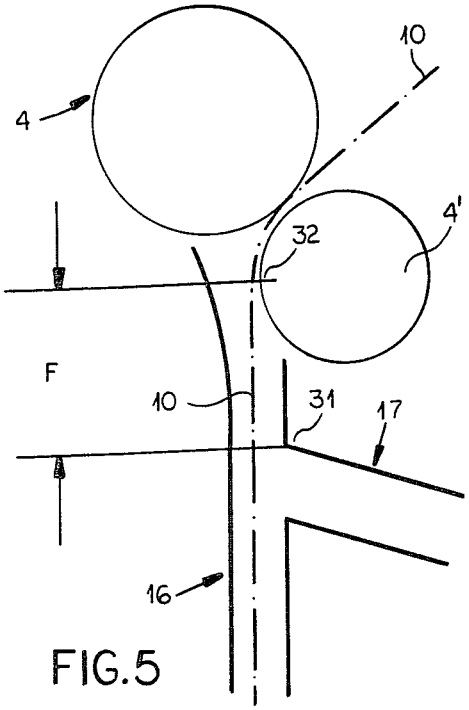
FIG. 5 is a view similar to that of FIG. 3 illustrating the instant invention.

FIG. 5 shows how the region F between the point of last contact 32 with the last roller 4' and the aspirating duct 17 where the air-current direction changes is maximized in order to give maximum opportunity for stray fibers to be wound back into the yarn 10. Drafting makes the yarn 10 twist, so that it will automatically wind any such stray fibers back in.

Figure 6:
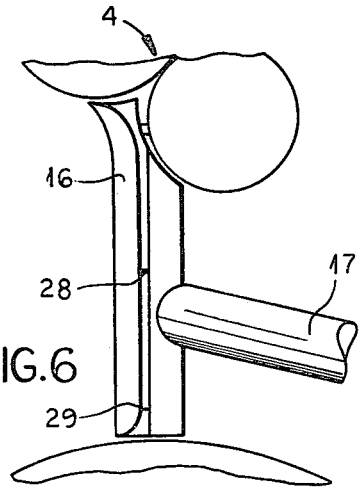
FIG. 6 is a view similar to that of FIG. 3 showing a detail of another arrangement according to this invention.

The tube 16 is shown in FIG. 6 to have a full-length radially throughgoing slit 28 having a widened and rounded lower end 29. This slit 28 serves for threading the core yarn 10 through the tube 16, but is not so wide as to allow the generation of spurious air currents that would counter the effects of the currents I and II.

Figure 7:
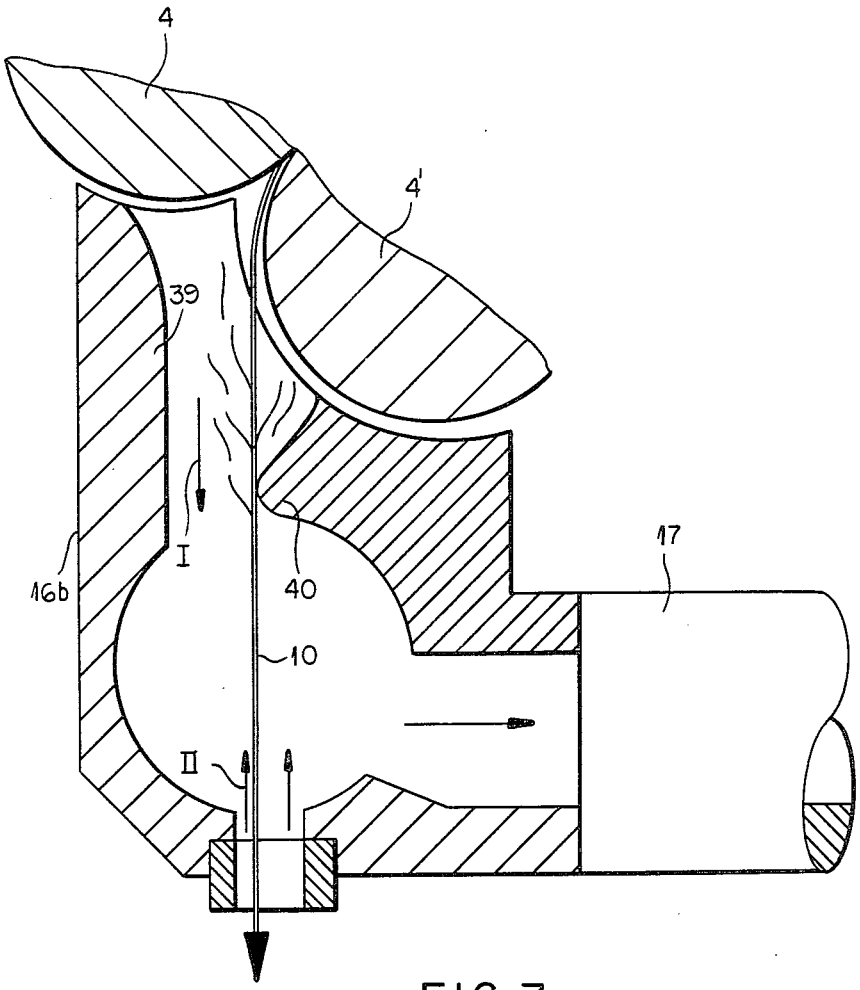
FIG. 7 is a vertical section through a detail of another arrangement according to the present invention.

Finally FIG. 7 shows a tube **16*b* whose inner wall 39 is formed with a thread-engaging bump or ridge 40 that flattens loose fibers against the yarn 10. This ridge 40 could be a helical inwardly projecting ridge or could be formed like a washboard. It only very lightly engages the yarn 10**, just enough to bend back stray fibers.

Thus with the system according to the instant invention the amount of fibers released to the atmosphere around the machine is greatly reduced. In addition the device ensures that most of the stray fibers will be reintegrated into the finished yarn 26. Finally the device ensures that, if the core yarn 10 breaks, it will be aspirated and not tangle itself in the mechanism.

I claim:

1. A method of making a doubled yarn comprising the steps of:

drawing a core yarn off a core-yarn supply and pulling said core yarn longitudinally in a travel direction along a yarn path;

drafting said core yarn longitudinally at a drafting station along said path;

winding a winder yarn around said core yarn at a winding location downstream of said drafting station and thereby doubling said core yarn;

passing a current of air longitudinally in said direction along said core yarn along an upstream section of said path downstream of said station and upstream of said winding location; and passing a current of air longitudinally opposite to said direction along said core yarn along a downstream section of said path immediately downstream of air upstream section and immediately upstream of said winding location.

2. An apparatus for making a doubled yarn, said apparatus comprising:

means for drawing a core yarn off a core-yarn supply, for pulling said core yarn longitudinally in a travel direction along a yarn path, and for drafting said core yarn longitudinally at a drafting station along said path;

a tube extending along and surrounding said path downstream of said drafting station and having relative to said direction an upstream portion and a downstream portion;

means for passing a current of air longitudinally in said direction along said core yarn in said upstream portion and for passing a current of air longitudinally opposite to said direction along said core yarn in said downstream portion; and means for winding a winder yarn around said core yarn at a winding location immediately downstream of said tube.

3. The apparatus defined in claim 2 wherein said means for passing said current of air includes an aspirating duct opening into said tube between said portions thereof and means for aspirating air through said duct.

4. The apparatus defined in claim 3 wherein said portions of said tube are of relatively small cross-sectional area and said tube has a central portion of relatively large cross-sectional area connected to said aspirating duct.

5. The apparatus defined in claim 3 wherein said portions of said tube are of different cross-sectional area.

6. The apparatus defined in claim 5 wherein said downstream portion is of smaller cross-sectional area than said upstream portion.

7. The apparatus defined in claim 3 wherein said portions of said tube are coaxial and said duct extends at an acute angle to said portions.

8. The apparatus defined in claim 3 wherein said means for drafting includes a pair of drafting rollers immediately upstream of said tube, said upstream portion having a rim closely juxtaposed with said drafting rollers.

9. The apparatus defined in claim 3 wherein said tube is formed along its full length with a radially throughgoing threading slit.

10. The apparatus defined in claim 9 wherein said slit is widened and rounded at one end.

11. The apparatus defined in claim 3 wherein said portions are of unequal length.

12. The apparatus defined in claim 3 wherein said tube lies wholly out of contact with said core yarn upstream of said aspirating duct.

13. The apparatus defined in claim 3 wherein said tube is formed internally with at least one projection engaging and rubbing against said core yarn.

14. The apparatus defined in claim 3, further comprising a valve in said aspirating duct.

15. The apparatus defined in claim 14, further comprising control means for sensing core-yarn breakage and for opening said valve fully on sensing such breakage.

16. The apparatus defined in claim 3, further comprising means for catching fibers in said aspirating duct.

17. The apparatus defined in claim 3 wherein said means for winding includes means for rotating a winder-yarn supply about an axis, said tube being coaxial with said axis.

18. The apparatus defined in claim 17 wherein said means for winding includes a hollow spindle of the same general cross-sectional size and shape as said tube centered on said axis and traversing said winder-yarn supply.

* * * * *